US006638119B1

(12) United States Patent
Chang

(10) Patent No.: US 6,638,119 B1
(45) Date of Patent: Oct. 28, 2003

(54) CONTACTS ON AN INTEGRATED CIRCUIT CHIP

(75) Inventor: Che-Chia Chang, Taipei (TW)

(73) Assignee: Comax Technology Inc., Taipei (TW)

( * ) Notice: Subject to any disclaimer, the term of this patent is extended or adjusted under 35 U.S.C. 154(b) by 0 days.

(21) Appl. No.: 10/175,907

(22) Filed: Jun. 21, 2002

(30) Foreign Application Priority Data

Apr. 18, 2002 (TW) ..... 91205186 U

(51) Int. Cl.[7] ..... H01R 11/22
(52) U.S. Cl. ..... 439/857; 439/342
(58) Field of Search ..... 439/342, 857, 439/83, 876, 259, 856

(56) References Cited

U.S. PATENT DOCUMENTS 5,797,774 A * 8/1998 Kaneko ..... 439/342
5,860,838 A * 1/1999 Kaneko ..... 439/857
6,142,810 A * 11/2000 Hsiao et al. ..... 439/342
6,267,615 B1 * 7/2001 Lin ..... 439/342

* cited by examiner

*Primary Examiner*—Gary Paumen
(74) *Attorney, Agent, or Firm*—Troxell Law Office PLLC

(57) ABSTRACT

Contacts on an integrated circuit chip are arranged at a lower seat of a base on the integrated circuit chip. Each of the contacts includes a main part, two bowed wing parts located at both sides of the main part, two elastic arms extended upward from one end of each wing part, two clamp parts at the upper edge of the elastic arms and a bearing part for adhering a tin ball. A support part extended from the bottom edge of the wing part to support against the bearing part. The above mentioned structure allows the bearing part of the contact to be fixed on the same plane during assembling and leveling, thus preventing any deformation resulting from being pressed for facilitating better adhesion of the tin ball.

5 Claims, 5 Drawing Sheets

CONTACTS ON AN INTEGRATED CIRCUIT CHIP

BACKGROUND OF THE INVENTION

1. Field of the Invention

The present invention relates to contacts on an integrated circuit chip, and particularly to improvement for contacts on an integrated circuit chip, with which each of the contacts at the bearing part thereof can be disposed at the same level during the contacts being inset and flattened, so that deformation resulting from being pressed can be avoided to facilitate the adhesion of the tin solder ball.

2. Description of Related Art

Presently, the base of an integrated circuit chip is associated with the main board by way of contacts on the base are arranged a tin solder ball respectively and the base being possible to be welded to the main board directly in the process of passing tin solder furnace instead of the conventional way that the contacts are inserted into the base first and then are welded to the main board.

A type of contact available in the market provides an elongated hole with a shape of bended clip. The elongated hole is used for being inserted with connecting pins on the integrated circuit chip and the tin solder ball is disposed at an open end of the contact.

However, it is hard for the preceding tin solder ball to join with the contact and it is easy for the tin solder ball to be disposed at a level different from that of the neighboring tin solder balls. Besides, it is easy for the tin solder ball to fall down during the process of tin solder ball being embedded. Moreover, there is no locating device between the base and the contacts so that the contacts are not possible to be located at the base firmly and it results in the contacts being disposed at inconsistent levels on the base after being inserted into contact grooves. Hence, the conventional contacts do not allow the base on the integrated circuit chip to contact with the main board correctly.

U.S. Pat. No. 6,267,615 discloses a contact, which includes a main part, wing parts, elastic arms, a clamp part and a bearing part. The wing parts are bowed and provided at both lateral sides of the main part with a respective end thereof extending upward the elastic arms with a space between the elastic arms being getting smaller to the top thereof. The clamp part is disposed at the upper edge of the contact with asymmetric guide planes.

Because the asymmetric guide planes of the clamp part on the contact disclosed in the U.S. Pat. No. 6,267,615 cause the connecting pins on the integrated circuit chip moving along non-smoothly displacement lines, it is very likely for the connecting pins to become bent during the process of contacting with the base thereof and a phenomenon of improper contact will occur. Further, the contact being located at the base totally depends on frictional interference between the contact and the base instead of a locating device so that inconsistent inserted positions can occur in case of all the same type contacts being inserted to the base. Under this circumstances, it is hard for the contact to join with a tin solder ball and an inconsistent level will occur in case of comparing to tin solder balls in neighboring contacts. Moreover, there is no support for the bearing part of the contact itself so that the bearing part is easy to become bent as the contact is inserted into the contact groove. Hence, the bearing part of each contact is not possible to be fixed at the same level and consistent positions for the contacts are not possible to obtain such that the tin solder balls are not possible to join with the contacts. Furthermore, because a great deal of contacts are inserted into the base SO that it is easy for the base to become deformed under the condition of the contacts interfering each other and squeezed each other.

SUMMARY OF THE INVENTION

A primary object of the present invention is to provide contacts on an integrated circuit chip, with which the contacts at the bearing parts thereof can be disposed at the same level during the contacts being inset with a base of the integrated circuit chip and being flattened, so that deformation resulting from being pressed can be avoided so as to facilitate the adhesion of the tin solder balls.

BRIEF DESCRIPTION OF THE DRAWINGS

The present invention can be more fully understood by reference to the following detailed description and accompanying drawings, in which:

FIG. 2-1 is a diagrammatic view illustrating the contact of the present invention in the process of being inserted into a stopper;

FIG. 2-2 is another diagrammatic view illustrating the contact of the present invention having been inserted into the stopper;

FIG. 3-1 is a lateral side view of FIG. 2-1 illustrating the contact in the process of being inserted into the stopper; and FIG. 3-2 is a side view of FIG. 2-2 illustrating the contact having been inserted into the stopper.

DETAILED DESCRIPTION OF THE PREFERRED EMBODIMENTS

Figure 1:
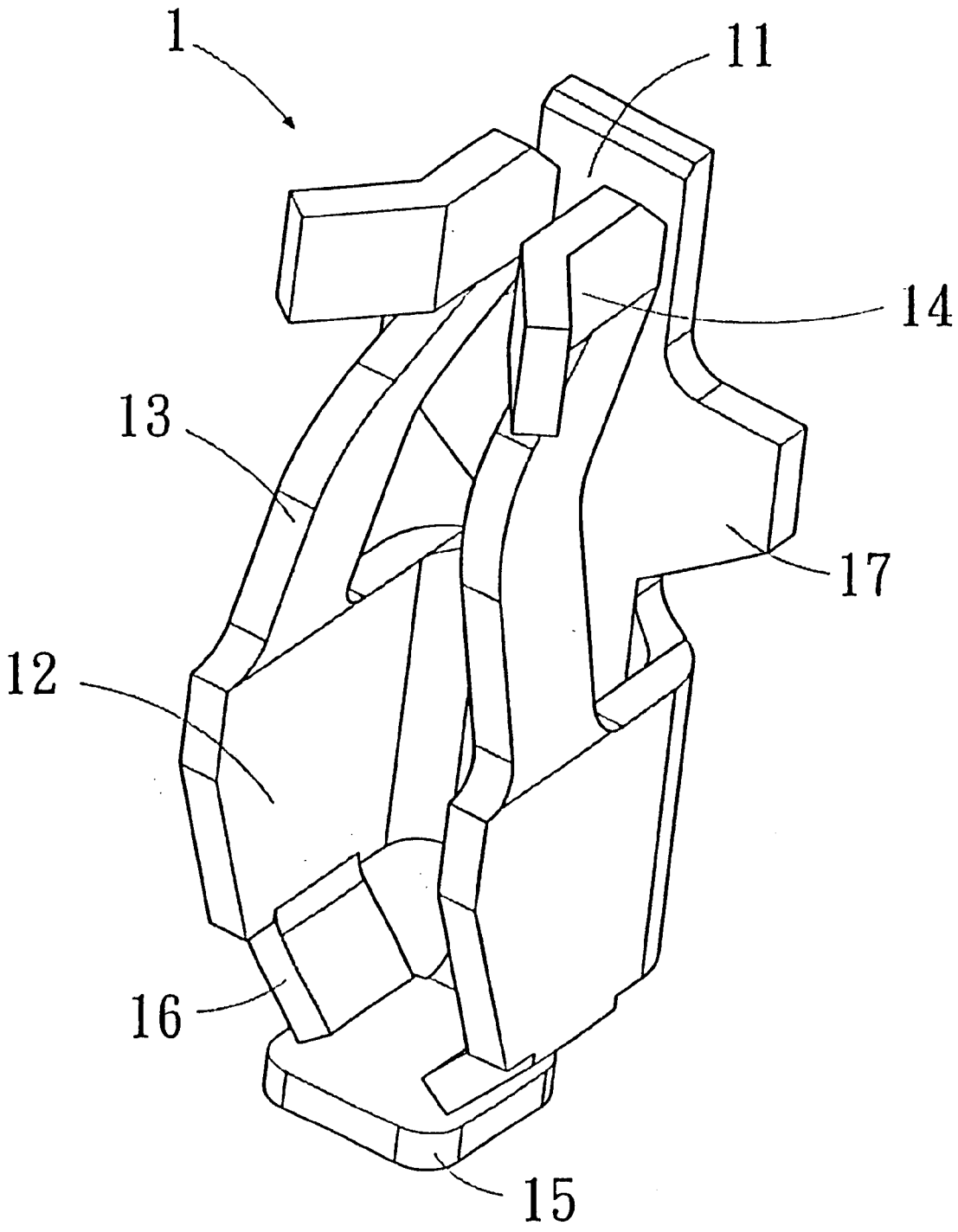
FIG. 1 is a perspective view of a contact on a central processing unit according to the present invention.

Referring to FIG. 1, contacts on an integrated circuit chip according to the invention on the integrated circuit chip are positioned in a plurality of contact grooves 21, which are disposed on a lower seat 2 of a base (not shown) of the integrated circuit chip. Each of the contacts 1 includes a main part 11, two curved wing parts 12 located at both sides of the main part 11, two elastic arms 13 extending upward from one end of each wing part 12, two clamp parts 14 at the upper edge of the elastic arms 13 and a bearing part 15 for adhering a tin ball. Each wing part 12 is bowed and placed at a suitable position from both sides of the main part 11 and then the two elastic arms 13 are extended upwards from the wing parts 12 in a way of the space between them getting smaller from bottom to top. The clamp parts 14 are disposed at the upper edge of each elastic arm 13 respectively and each of the clamp parts 14 has a guide plane 141 that forms an artic shape. Moreover, a support part 16 is extended from the other end of each wing part 12 and it forms a bent structure with the bearing part 15. At an appropriate position on the main part 11 close to each wing part 12, a stopper part 17 is located. A slot 211 is disposed at each of the opposite sides of a contact groove 21 of the lower seat 2 shown in FIG. 2-1. The slot 211 converges downwards so that the slot 211 and the stopper part 17 of the contact 1 press against and retain each other. Thus, the preceding structure of contacts on the integrated circuit chip allow the bearing part 15 of each contact 1 being located at the same level during being inset and flatten. Hence, any deformation resulting from being pressed during assembling the contacts can be avoided so that the contacts of the present invention facilitate adhesion of the tin ball.

Figures 1, 2:
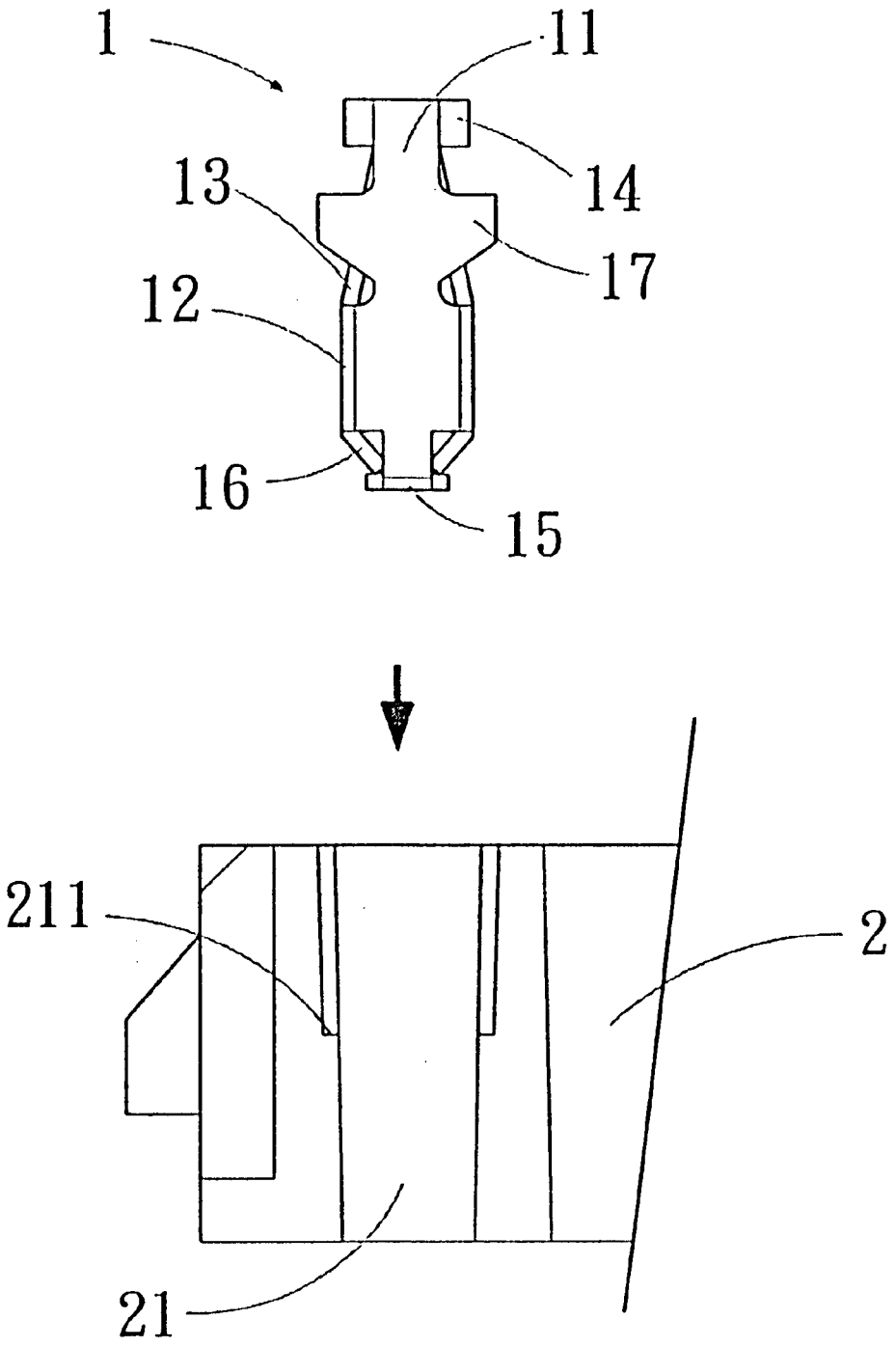
Figure 2:
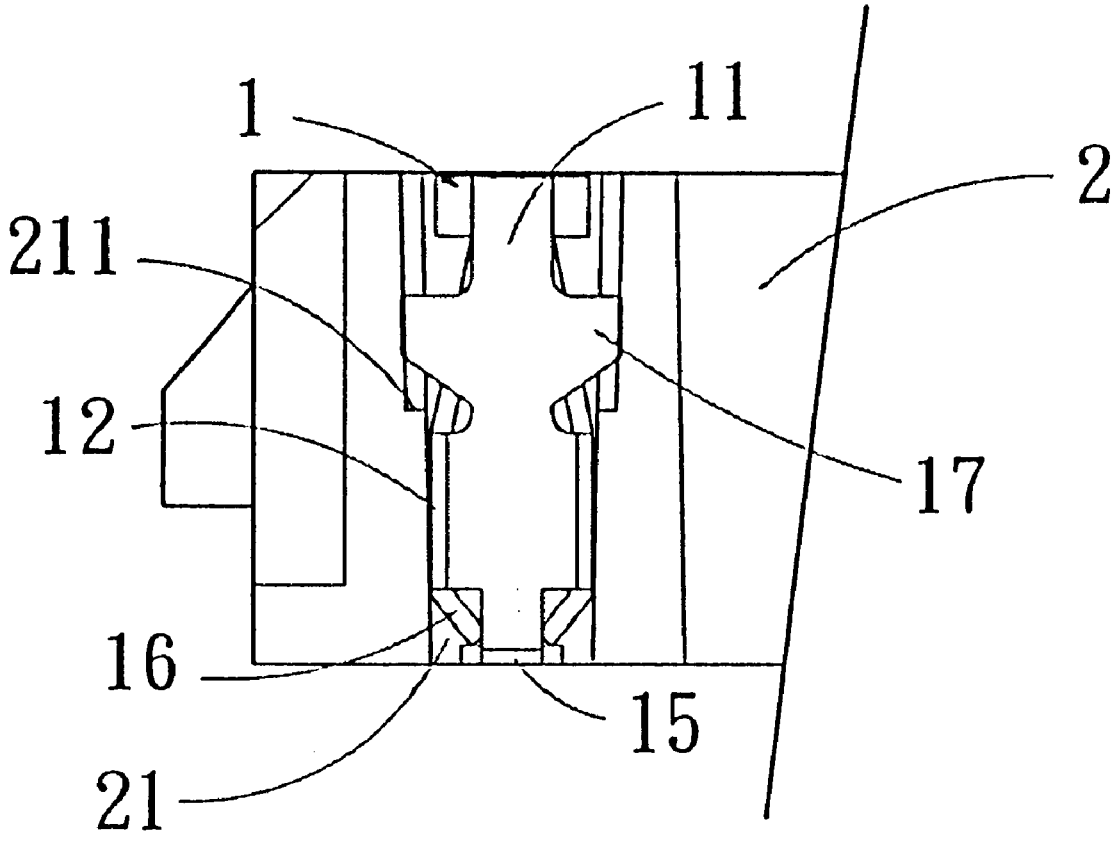
Figures 1, 3:
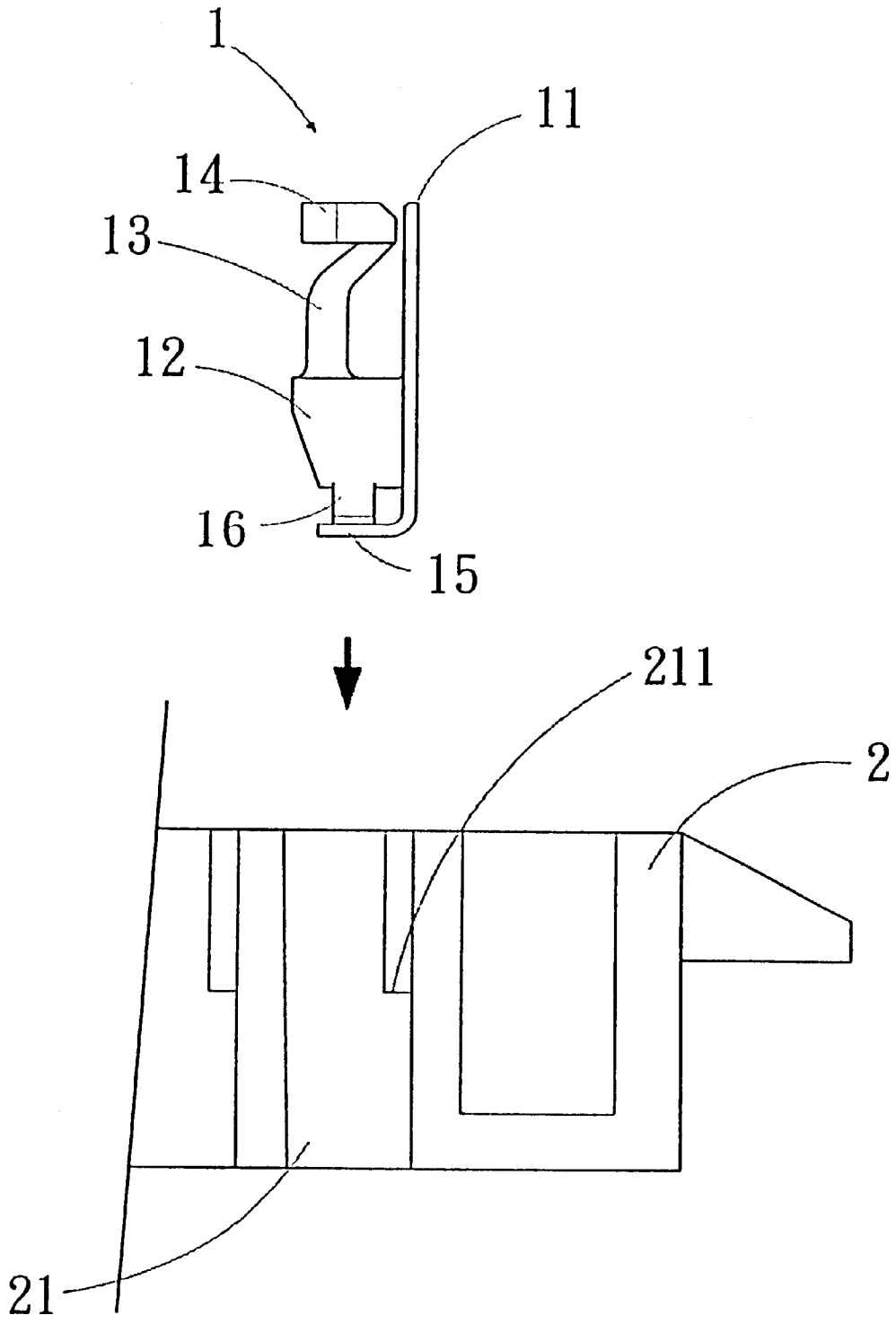
Figures 2, 3:
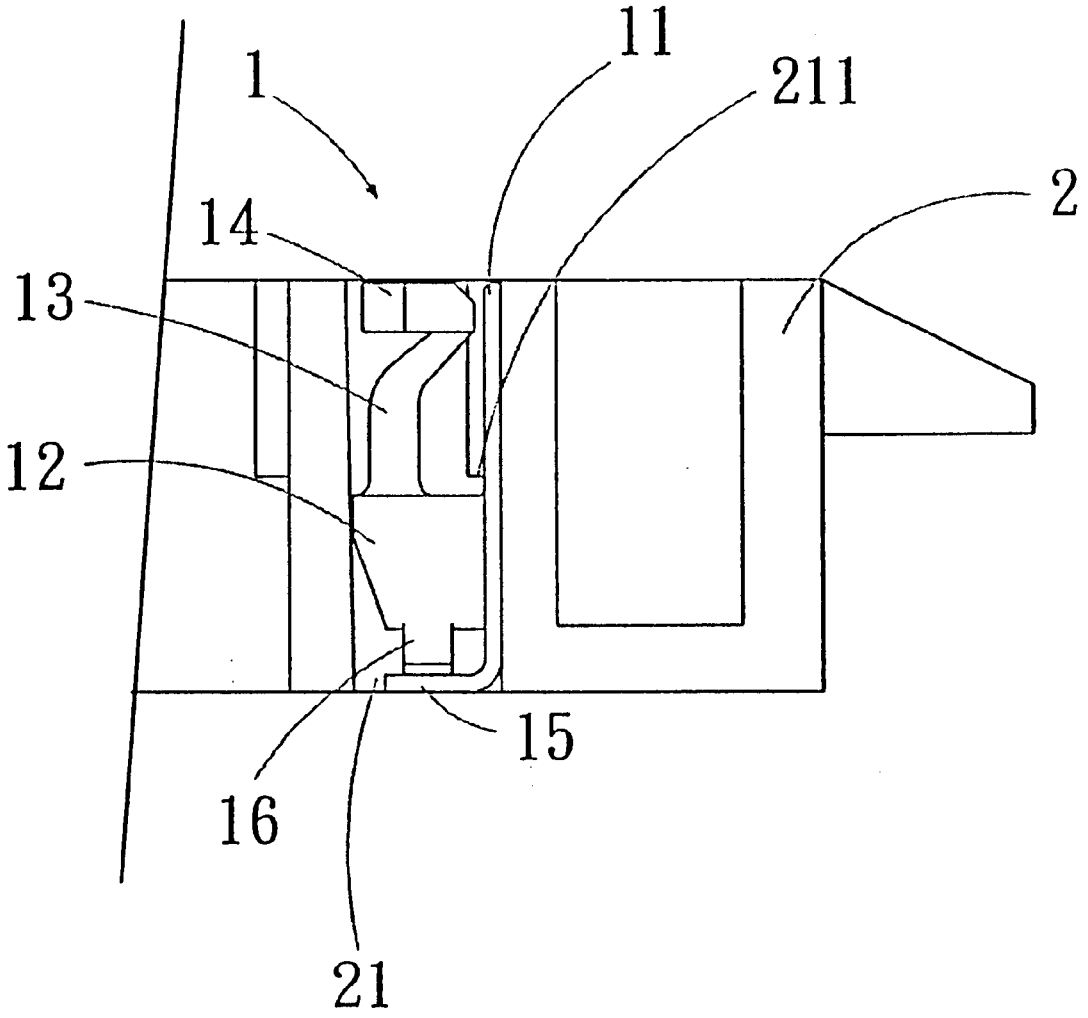

Referring to FIGS. 2-1, 2-2, 3-1 and 3-2, when assembling the contacts 1 of the invention, the stopper parts 17 located on the two sides of the main part 11 of the contact 1 near the wing parts 12 will be inserted downwards into the corresponding slots 211 on both sides of the contact groove 21 on the lower seat 2. As the slot 211 is slowly converging downwards, it will provide a blocking effect when the contact 1 is inserted into the supposed position and thus facilitates the insertion of the contact 1 into the contact groove 21 on the lower seat 2. At the same time, the contact 1 having the support part 16 extended from the other end of the wing part 12 as support, the bearing part 15 can be fixed in the desired place and prevents the bearing part 15 of the contact 1 from deformation due to external pressure during assembling and leveling. In this way, the bearing part 15 of the contact 1 can be maintained on the same plane and allows the better adhesion of the tin ball (not shown).

While the invention has been described with reference to the a preferred embodiment thereof, it is to be understood that modifications or variations may be easily made without departing from the spirit of this invention, which is defined by the appended claims.

What is claimed is:

1. Contacts on an integrated circuit chip, being arranged at a lower seat of a base on the integrated circuit chip and each of the contacts comprising: a main part, two bowed wing parts located at both sides of the main part, two elastic arms extended upward from one end of each wing part, two clamp parts at the upper edge of the elastic arms and a bearing part for adhering to a tin ball;

characterized in that: a support part extended from a bottom edge of pack wing part to support against the bearing part;

whereby, the above mentioned structure allows the bearing part of the contact to be fixed on the same plane during assembling and leveling, thus preventing any deformation resulting from being pressed for facilitating better adhesion of the tin ball.

2. The contact on an integrated circuit chip as defined in claim 1, wherein each support part forms a bent shape in a direction toward the bearing part.

3. The contact on an integrated circuit chip as defined in claim 1, wherein on each side of the main part close to the wing part, there is situated a stopper part.

4. The contact on an integrated circuit chip as defined in claim 1, wherein a slot is provided on a contact groove of the lower seat at two opposite sides of the groove.

5. The contact on an integrated circuit chip as defined in claim 4, wherein the slot is converging downwards.

* * * * *